US005322462A

United States Patent [19]

Hull et al.

[11] Patent Number: 5,322,462

[45] Date of Patent: Jun. 21, 1994

[54] COMBINATION OAR AND BILGE PUMP

[76] Inventors: Harold L. Hull, 401 Canyon Way #43, Sparks, Nev. 89434; Pete Rasner, P.O. Box 2607, Carson City, Nev. 89702

[21] Appl. No.: 42,687

[22] Filed: Apr. 5, 1993

[51] Int. Cl.[5] ..... B63H 16/04

[52] U.S. Cl. ..... 440/101; 114/221 R

[58] Field of Search ..... 440/101, 102; 114/221 R, 230; 416/69, 74

[56] References Cited

U.S. PATENT DOCUMENTS

| | | | |
|---|---|---|---|
| 1,066,662 | 7/1913 | Schmidt, Jr. | 416/74 |
| 3,044,410 | 7/1962 | Edmundson | 416/74 |
| 3,165,067 | 1/1965 | Greenwald | 114/221 R |
| 3,518,024 | 6/1970 | Wilson | 416/72 |
| 3,677,216 | 7/1972 | Gentemann | 115/24.1 |
| 3,800,734 | 4/1974 | Whang | 115/31 |
| 3,970,031 | 7/1976 | Vrana | 115/21 |
| 3,970,032 | 7/1976 | Phillips | 115/24.1 |
| 4,264,275 | 4/1981 | Roderick | 416/74 |
| 4,664,637 | 5/1987 | Loerch | 440/101 |
| 5,041,037 | 8/1991 | Jaw | 440/102 |
| 5,074,815 | 12/1991 | Gibson | 440/101 |
| 5,163,778 | 11/1992 | Botero | 440/101 |

*Primary Examiner*—Edwin L. Swinehart

[57] ABSTRACT

Disclosed is a combination oar and bilge pump which serves as an oar when the apparatus is in a locked first position and when in an un-locked second position becomes a bilge pump by plunging a second tube member having a plunger on its inner end, inward and outward of a first tube member which acts as a gripping surface.

1 Claim, 2 Drawing Sheets

FIG 3
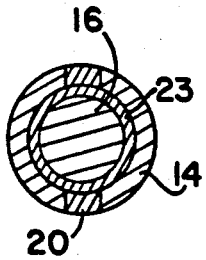
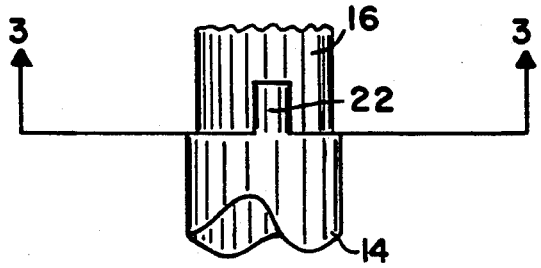
FIG 4
FIG 5
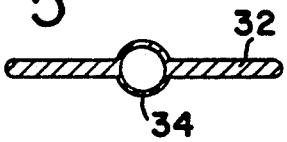
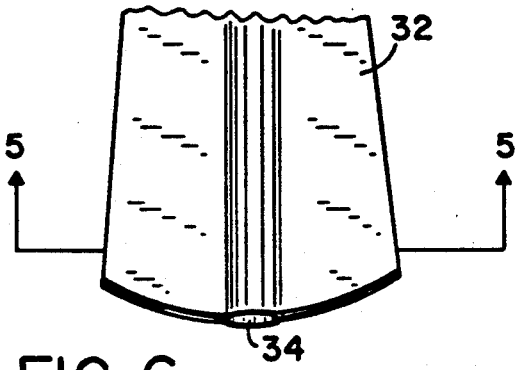
FIG 6

COMBINATION OAR AND BILGE PUMP

FIELD OF THE INVENTION

This invention relates to oars as used in small boats and bilge pumps and more particularly to a combination of both.

BACKGROUND OF THE INVENTION

There are many designs and constructions of oars and hand operated pumps in the prior art, and these have included both all wooden, all metal and hybrid wooden and metal oars. Previous patents include U.S. Pat. No. 4,264,275 which teaches a split oar with a stiffening shaft down its center line but has no utility other than an oar while U.S. Pat. No. 5,074,815 teaches an oar with its upper or inboard end being hollowed out to become a container for an inflatable life jacket or life raft, however, no means are disclosed in this reference to use the oar as a pump.

As it is a requirement in many states to have aboard a boat at least one oar and as it is well known that space inside a small boat is at a premium, it would be advantageous to make the oar do some other useful function in combination and it is to this end that the present invention teaches a combination oar and bilge pump.

Under stress situations whereby the boat is taking on water it would be a treat advantaged to have an oar which Can be used to not only row or steer the boat with but could perform as a bilge pump without having to lay down the oar and pick up and use a bilge pump.

SUMMARY OF THE INVENTION

It is therefore, a primary object to provide a combination oar and bilge pump.

Another object is to make the oar and pump in a manner in which the rower does not have to lay down one object and pick up another to serve two functions.

Still another object is to design the oar and pump in a manner that the position of hands on the oar is the same as when used as a pump.

Yet another object is to provide a locking arrangement between the pump shaft handle and the body of the oar to prevent twitting of the handle when used as an oar.

Other objects and advantage will become obvious when taken into consideration with the followings drawings and specifications.

BRIEF DESCRIPTION OF THE DRAWINGS

FIG. 3, is a section taken at 3—3 of FIG. 4.

FIG. 4, is a side view of the end of the oar shaft.

FIG. 5, is a section taken at 5—5 of FIG. 6.

FIG. 6, is a perspective view of the paddle end of a second embodiment

DETAILED DESCRIPTION OF THE DRAWINGS

Figures 1, 2:
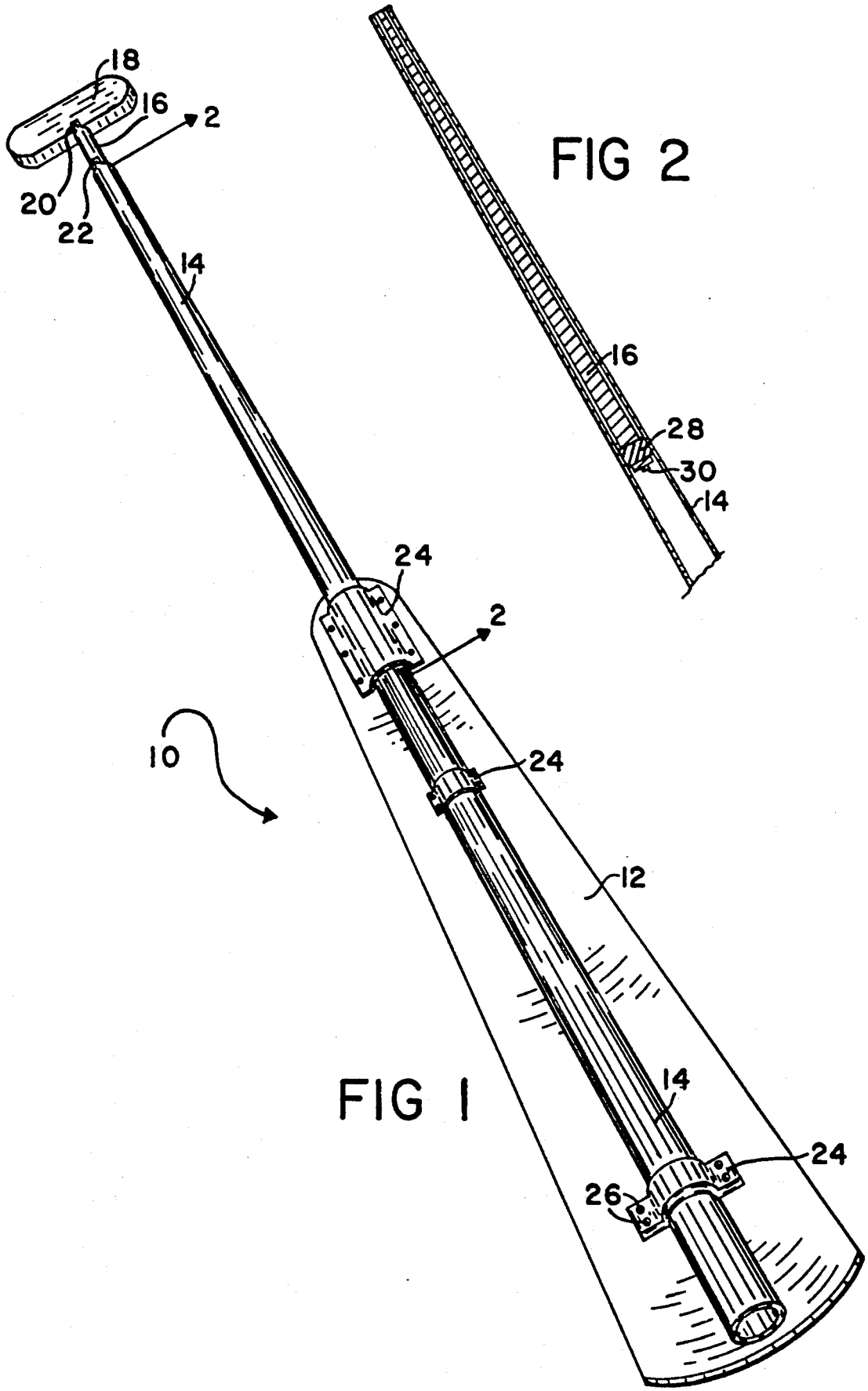
FIG. 1, is a perspective view of the combination oar and pump in a closed position.
FIG. 2, is a section taken at 2—2 of FIG. 1.

Referring now in detail to the drawings wherein like characters refer to like elements throughout the various drawings, 10 is an over view of the preferred embodiment with 12 being the body of the oar which may be made of wood, plastic, metal or other suitable material, while 14 is a hollow member, with 16 being a rod or shaft movably mounted within the interior of hollow member 14, with 18 being a handle suitably affixed to rod or shaft 16 and having indents 20 which mate with registering detent's 22 located at the inboard end of hollow member 14, while 23 is a bushing which may be pressed into the member 14 to act as a retainer and working bearing for shaft 16.

24 are multiple mounting brackets to attach the hollow member 14 to the oar body 12 and suitably mounted to the oar body 12 by multiple screws 26.

28 is a plunger which may be made of a material such as rubber or neoprene which slidably engages the interior walls of the hollow member 14 and is suitably affixed to shaft 16 at it's interior end to form a working relationship when the shaft 16 is plunged in and out of hollow member 14. 2B is suitably attached to shaft 16 by means such as nut 30.

In FIGS. 5 and 6, respectively, a second embodiment is shown which shows the paddle 32 having a bore 34 through its length to accommodate shaft 16 and in this embodiment the oar body 32 may be made of cast aluminum or fiber-glass construction for light weight construction and a more balanced oar.

It will now be seen that we have provided a combination oar and bilge pump which functions as an oar or a pump with no need to change the position of the hand for either function which becomes important under stress conditions.

We have also provided a non-twisting locking arrangement between the inner shaft and its plunger when it is in its "oar" position but is allowed to assume a free relationship when in its "pump" position.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A combination oar and bilge pump comprising; a blade member, said blade member having two sides, said blade having an outboard end and an inboard end, an elongated first tube member, said tube member being of a length longer than said blade member, means to affix said tube member to said blade member longitudinally on one of said sides of said blade member substantially along a center portion of one of said sides, said means to affix said first tube member to said blade member is by at least two brackets, said tube member extending at least to said outboard end of said blade member, said tube member extending above said inboard end forming a gripping surface, a second tube member, said second tube member being smaller in its outer circumference than the inner circumference of said first tube member, said second tube member having an outboard end and an inboard end, said second tube having a handle on its inboard end, said second tube member having plunger on its outboard end, a bushing, said bushing allowing a sliding relationship and providing support at said inboard end of said first and second tube members, locking means between said first and second tube members, said locking means being at least one mating indent and detent, said plunger providing an interference fit between said plunger and said inner circumference of said first tube member, whereby, when said first and second tube members are in an unlocked relationship, said second tube member may be plunged inward and outward within said first tube member providing an intake and an exhaust stroke thus being a bilge pump and when said first second tube members are in a locked relationship, said first and second tube members, said handle, said blade member and said means to affix said first tube member to said blade member being an oar.

* * * * *